US008276484B2

(12) United States Patent
Huang

(10) Patent No.: US 8,276,484 B2
(45) Date of Patent: Oct. 2, 2012

(54) ADJUSTABLE WRENCH

(75) Inventor: Ping-Wen Huang, Taichung (TW)

(73) Assignee: New Way Tools Co., Ltd., Taichung (TW)

( * ) Notice: Subject to any disclaimer, the term of this patent is extended or adjusted under 35 U.S.C. 154(b) by 0 days.

(21) Appl. No.: 13/267,923

(22) Filed: Oct. 7, 2011

(65) Prior Publication Data

US 2012/0180604 A1 Jul. 19, 2012

(30) Foreign Application Priority Data

Jan. 13, 2011 (TW) ..... 100101250

(51) Int. Cl.
*B25B 13/20* (2006.01)

(52) U.S. Cl. ..... 81/165; 81/126; 81/170; 81/133

(58) Field of Classification Search ..... 81/165, 81/133–135, 145, 170, 157
See application file for complete search history.

(56) References Cited

U.S. PATENT DOCUMENTS 3,926,077 A * 12/1975 Nordgren ..... 81/126
5,297,459 A * 3/1994 Stojanowski ..... 81/165
6,089,129 A * 7/2000 Huang ..... 81/133
6,336,384 B1 1/2002 Huang ..... 81/165
6,418,819 B1 * 7/2002 Kuo ..... 81/165
7,137,321 B1 * 11/2006 Huang ..... 81/126
8,136,429 B2 * 3/2012 Wu ..... 81/165
2012/0055292 A1 * 3/2012 Cheng ..... 81/165

* cited by examiner

*Primary Examiner* — Monica Carter
*Assistant Examiner* — Melanie Alexander
(74) *Attorney, Agent, or Firm* — Alan Kamrath; Kamrath IP Lawfirm, PA

(57) ABSTRACT

An adjustable wrench includes a fixed jaw, a movable jaw, and a handle. The fixed jaw includes a chamber and a hole defined therein. An adjusting mechanism and an abutting mechanism are disposed in the chamber. The adjusting mechanism includes a worm gear and a fixing member. The abutting mechanism includes an abutting member. The handle is pivotally fixed to the fixed jaw. The adjustable wrench is operable in a first direction wrenching an object and includes the worm gear stopped from moving along the fixing member by the abutting member fixedly abutting against the worm gear. The adjustable wrench is operable in a second direction moving relative to the object and includes the worm gear adapted to be moved with respect to the fixing member and including the movable jaw moving with respect to the fixed jaw and the abutting member not fixedly abutted against the worm gear.

13 Claims, 14 Drawing Sheets

ADJUSTABLE WRENCH

BACKGROUND OF THE INVENTION

1. Field of the Invention

The present invention relates to an adjustable wrench and, in particular, to an adjustable wrench for quickly turning an object.

2. Description of the Related Art

U.S. Pat. No. 6,336,384 shows an adjustable wrench for quickly turning an object. The adjustable wrench includes a main body, a slide block, a movable jaw and a grip. The main body includes a jaw section and a hollow section. The slide block and the movable jaw are disposed in the hollow section. The grip is pivotally connected with the hollow section. A movable retaining block is disposed on one side of the top end of the grip and is opposite to a leaning section of the slide block. The retaining block can be switched. When the grip is wrenched in different directions, the retaining block abuts against and pushes the leaning section of the slide block to move the movable jaw toward the jaw section of the main body for clamping and wrenching a work piece. When the retaining block does not abut against the leaning section, turning the grip with respect to the work piece would cause the work piece to shift the slide block and the movable jaw and to make the main body idle. However, the adjustable wrench is not suitable to a high-torque wrenching operation, as the retaining block, which should be prevented from moving, is liable to move relative to the slide block, and as a detent ball, which is biased by a spring, is liable to disengage from a recessed section of the grip.

The present invention is, therefore, intended to obviate or at least alleviate the problems encountered in the prior art.

SUMMARY OF THE INVENTION

According to the present invention, an adjustable wrench includes a fixed jaw, a movable jaw, and a handle. The fixed jaw includes a first end, a second end, a chamber and a hole defined therein. The hole extends from the chamber to an outer periphery of the fixed jaw. The chamber includes an adjusting mechanism and an abutting mechanism disposed therein. The adjusting mechanism includes a worm gear, a fixing member, and a first biasing member. The worm gear includes the fixing member inserted therein. The worm gear is rotatable about and movable along the fixing member. The fixing member is inserted through the hole. The first biasing member is engaged with the worm gear. The abutting mechanism includes an abutting member and a second biasing member. The abutting member is engagable with the worm gear and engaged with the second biasing member. The movable jaw is movably received in the second end of the fixed jaw and engaged with the worm gear. The movable jaw moves linearly relative to the fixed jaw upon rotating the worm gear. The handle is pivotally fixed to the fixed jaw and allows grasping by a user.

The adjustable wrench is operable in a first direction wrenching an object and including the worm gear stopped from moving along the fixing member by the abutting member fixedly abutting against the worm gear. The adjustable wrench is operable in a second direction moving relative to the object and including the worm gear adapted to be moved with respect to the fixing member and including the movable jaw moving with respect to the fixed jaw and including the abutting member not fixedly abutted against the worm gear.

It is an objective of the present invention to provide an adjustable wrench for quickly turning an object It is an objective of the present invention to provide an adjustable wrench having a satisfactory structural strength.

It is another objective of the present invention to provide an adjustable wrench usable in a circumstance which requires a relatively large torque to turn an object.

Other objectives, advantages, and new features of the present invention will become apparent from the following detailed description of the invention when considered in conjunction with the accompanied drawings.

DETAILED DESCRIPTION OF THE PREFERRED EMBODIMENTS

Figure 1:
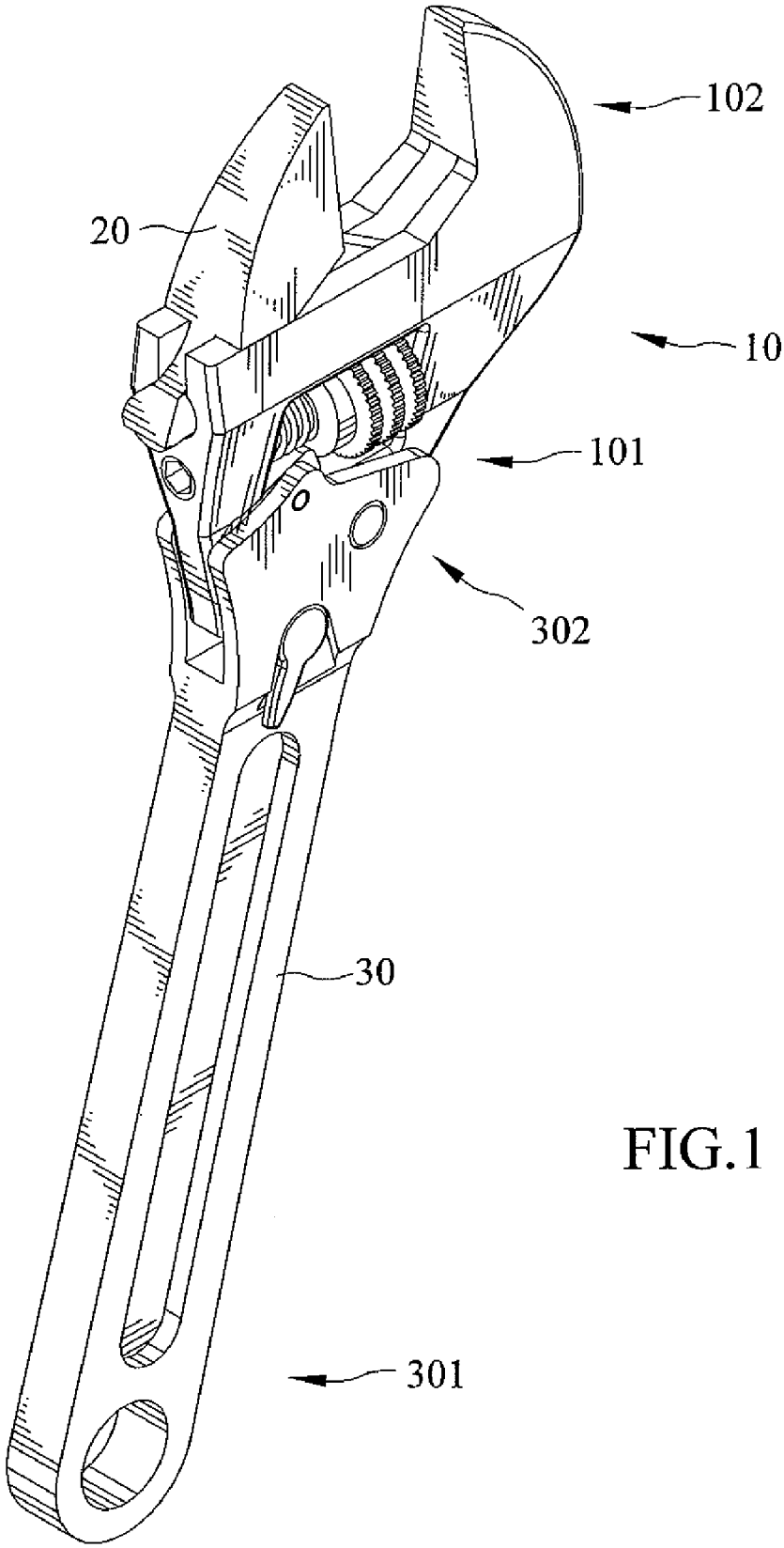
FIG. 1 is a perspective view of an adjustable wrench in accordance with a first embodiment of the present invention.
Figure 2:
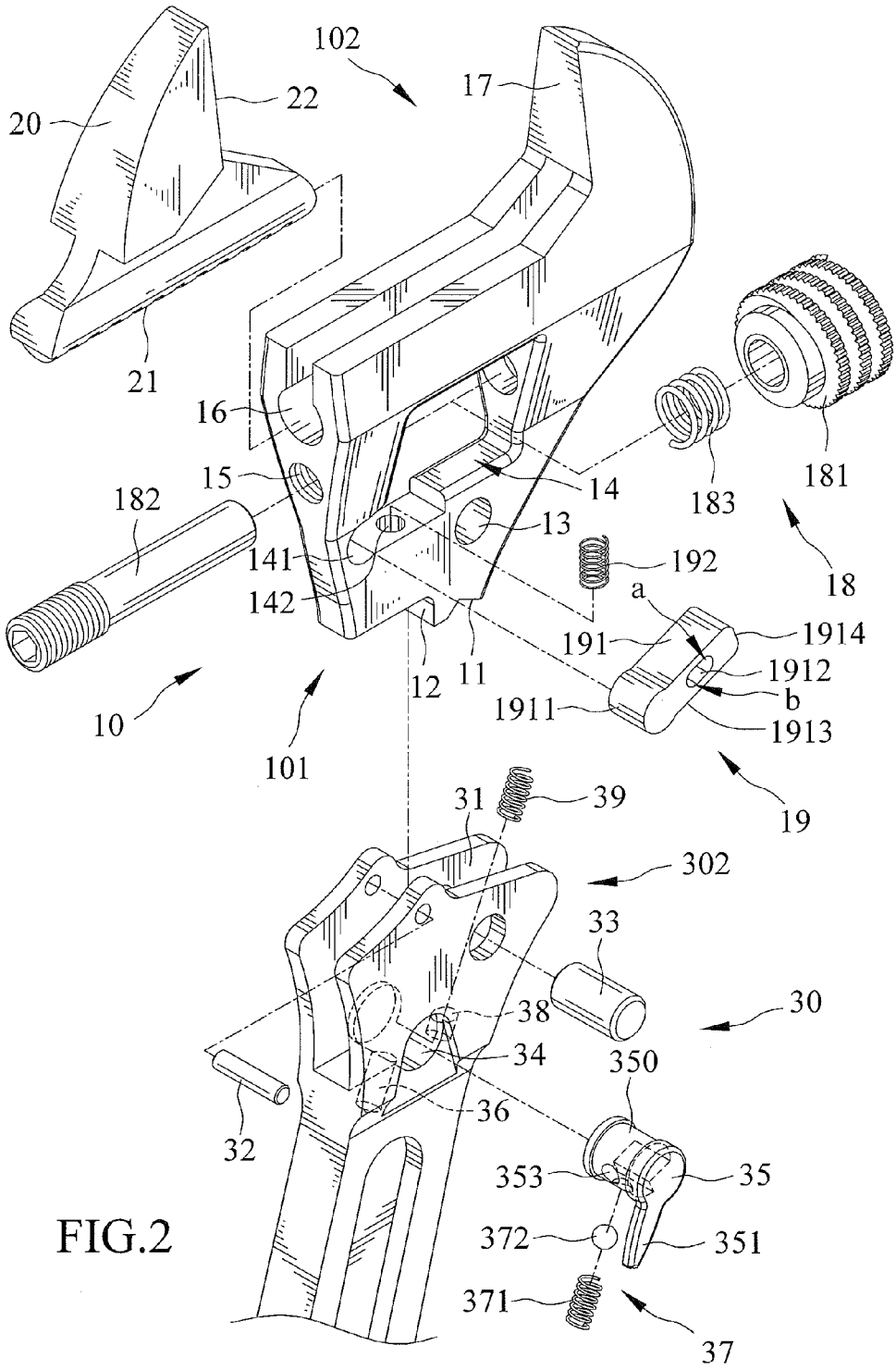
FIG. 2 is an exploded perspective view of the adjustable wrench of FIG. 1.
Figure 3:
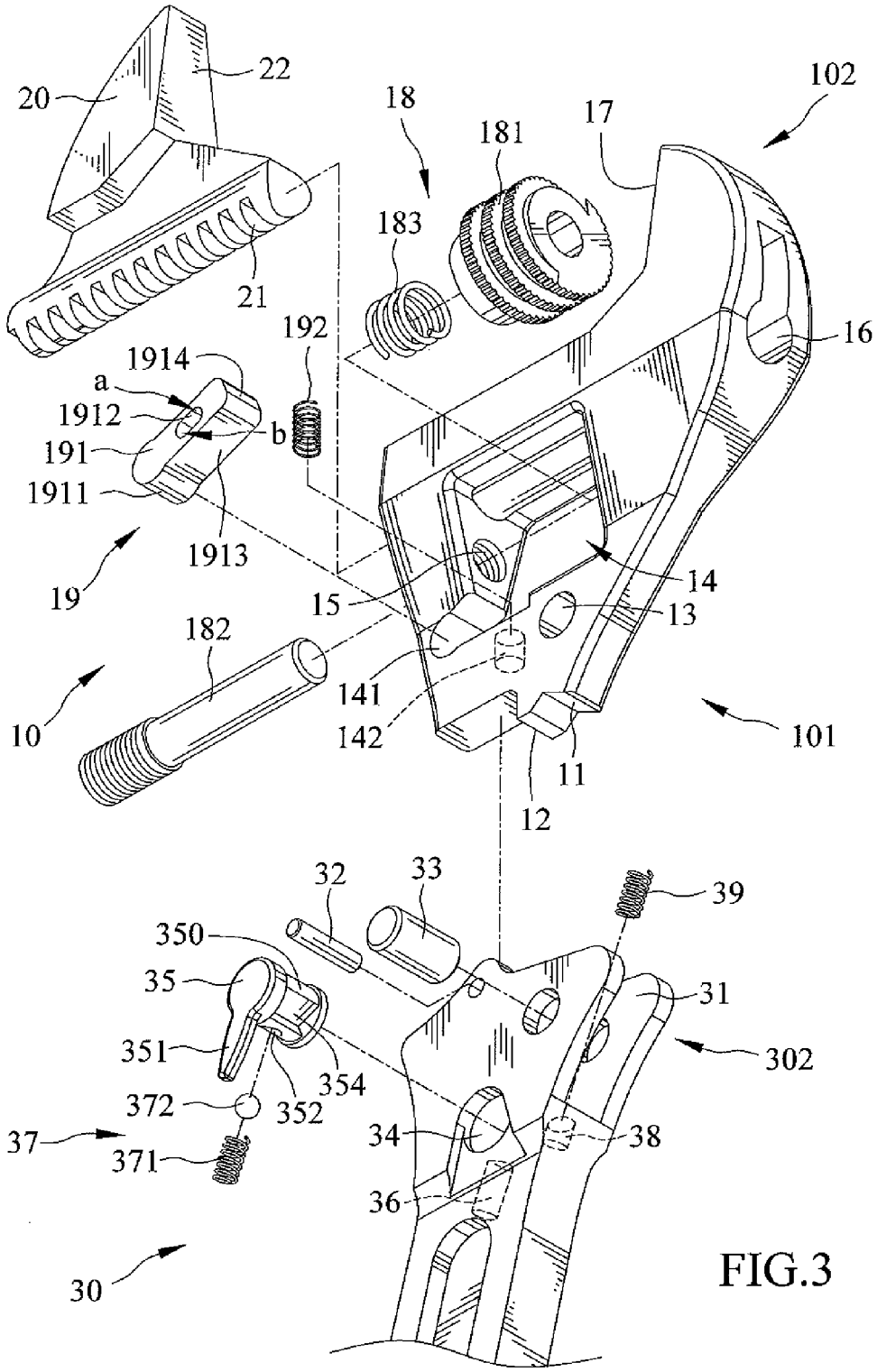
FIG. 3 is another exploded perspective view of the adjustable wrench of FIG. 1, taken from a different angle than that of FIG. 2.
Figure 4:
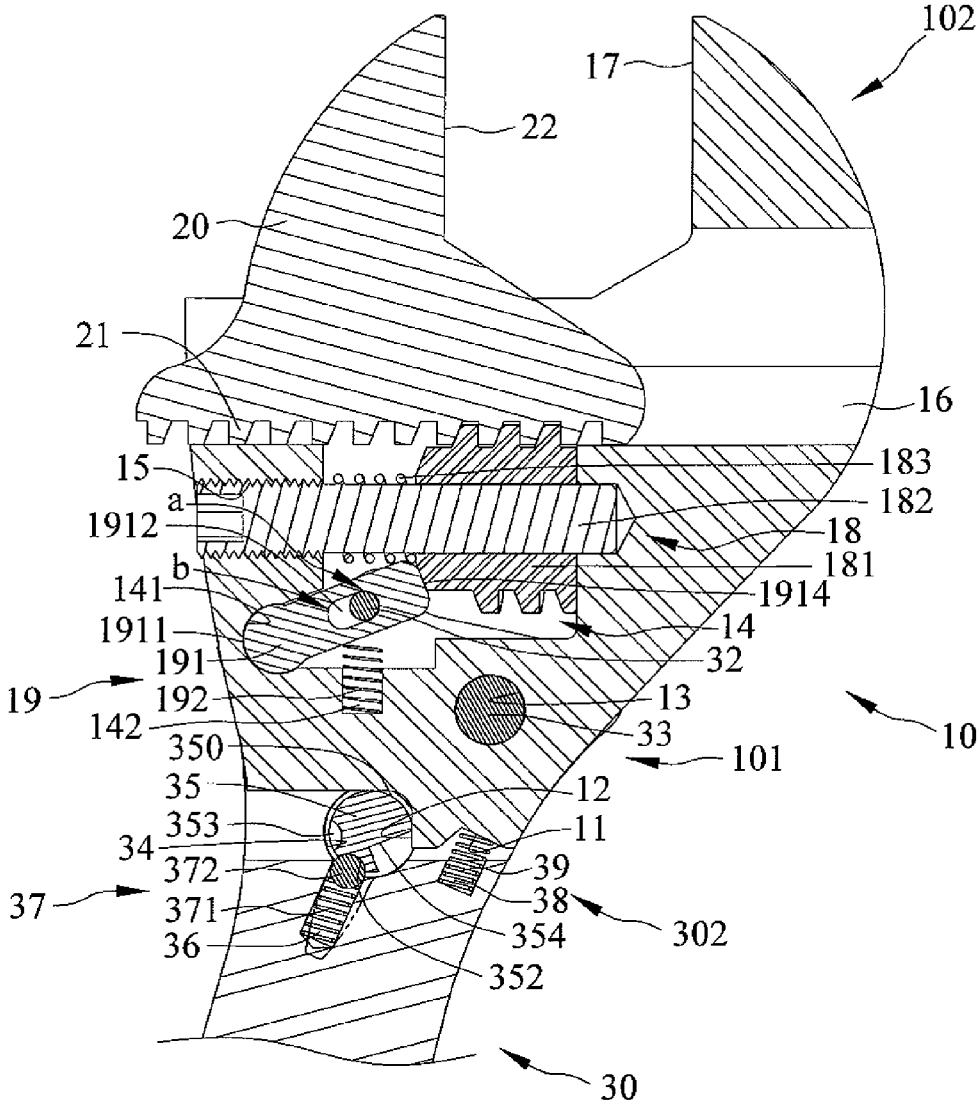
FIG. 4 is a cross-sectional view of the adjustable wrench of FIG. 1.
Figure 5:
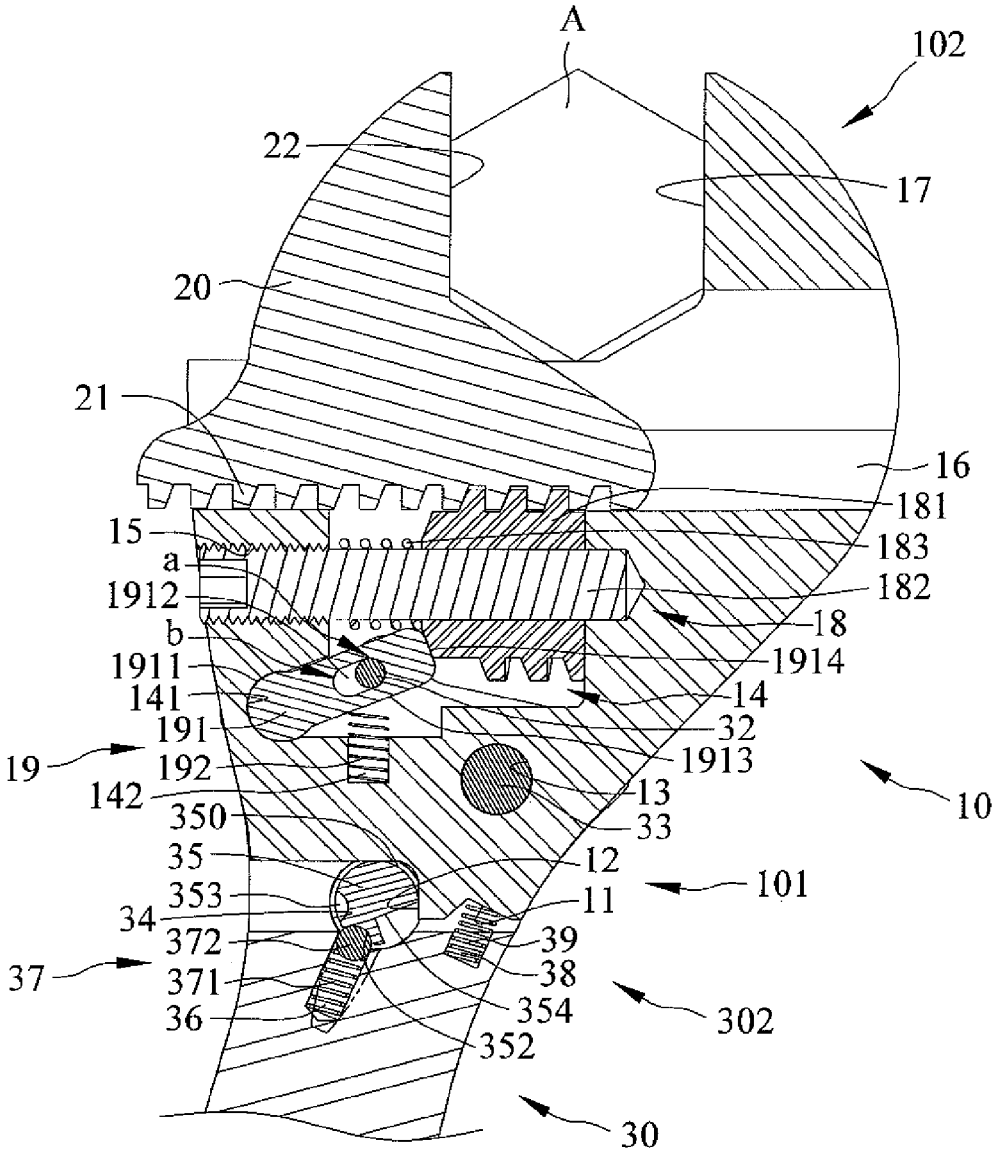
FIG. 5 is an extended cross-sectional view of FIG. 4, showing an object disposed between a fixed jaw and a movable jaw of the adjustable wrench.
Figure 6:
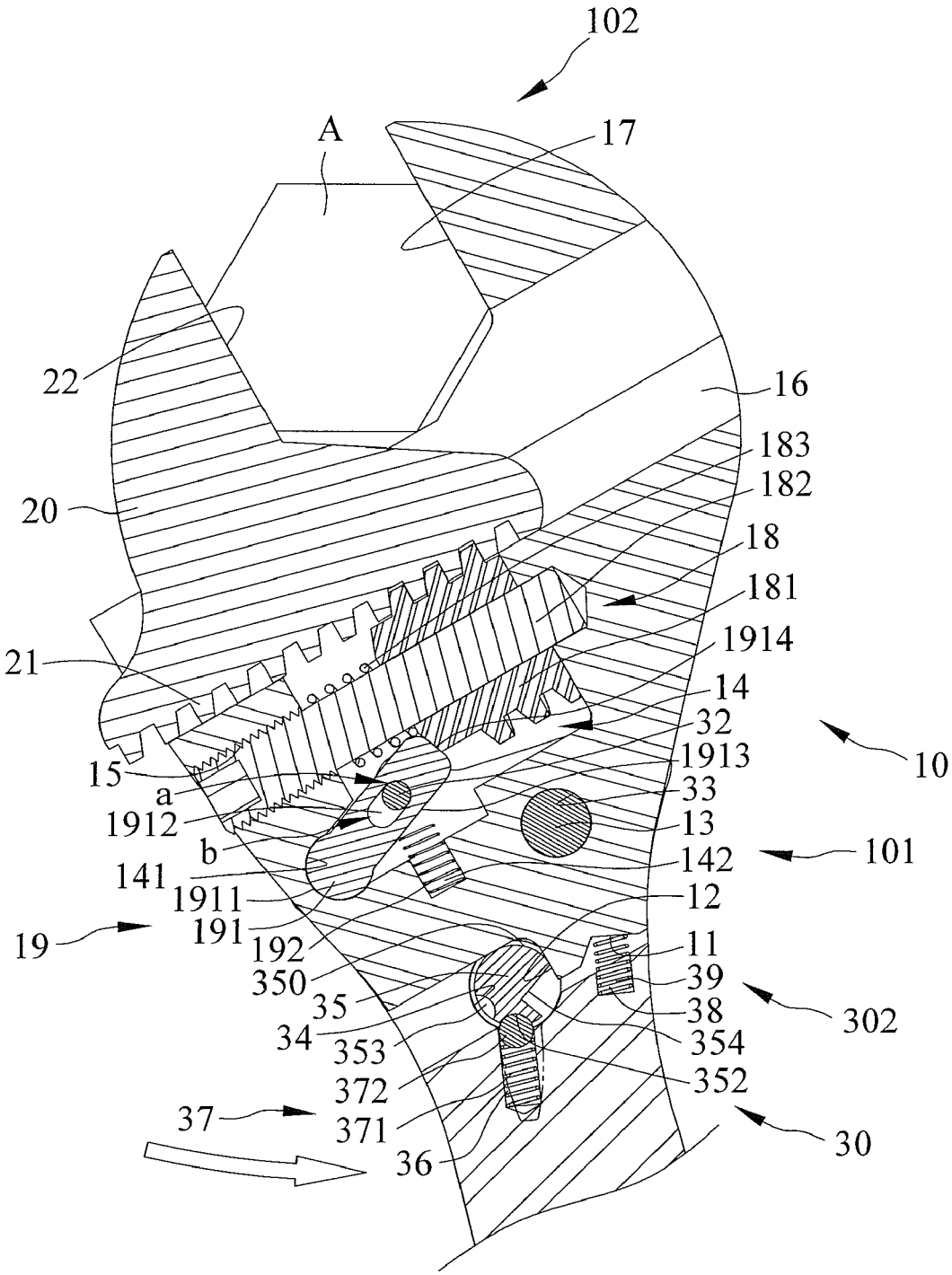
FIG. 6 is a continued view of FIG. 5, showing the operation of the adjustable wrench in a first operating direction wrenching the object.
Figure 7:
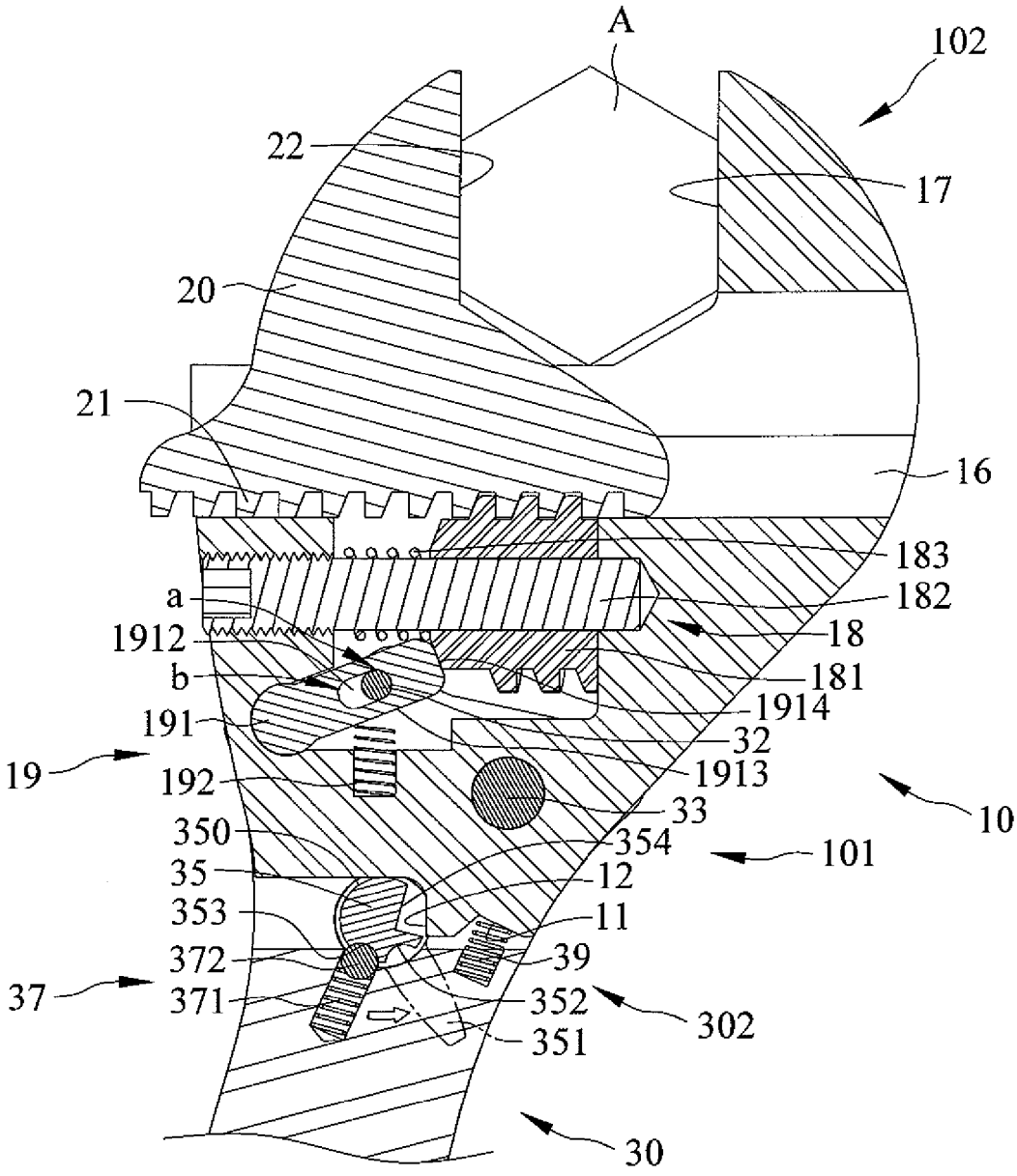
FIG. 7 is a cross-sectional view similar to FIG. 5, except with a switch of the adjustable wrench in a switching position different than that of FIG. 5.
Figure 8:
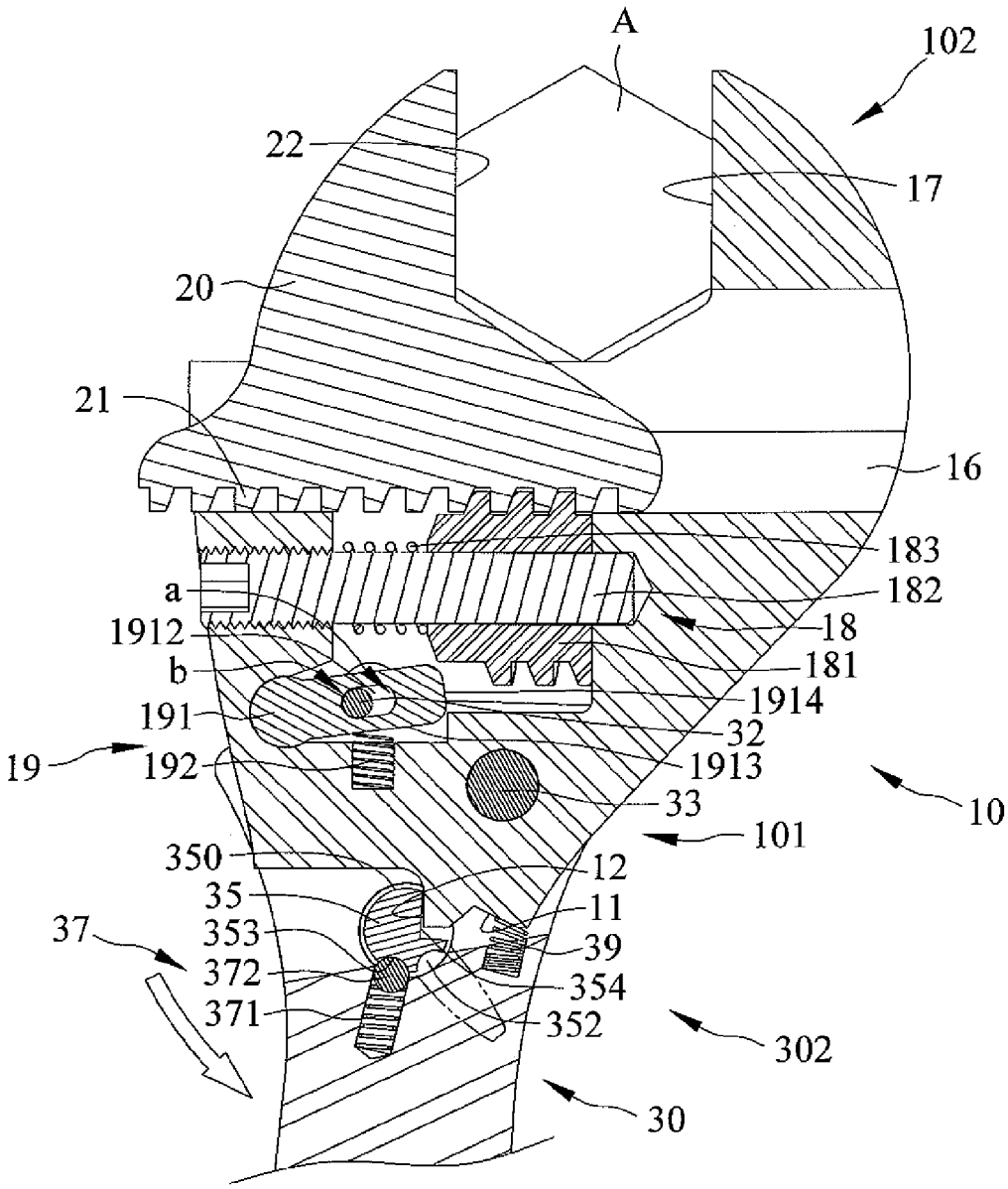
FIG. 8 is a continued view of FIG. 7, showing the operation of the adjustable wrench in the first operating direction moving relative to the object moving relative to the object engaged therewith.
Figure 9:
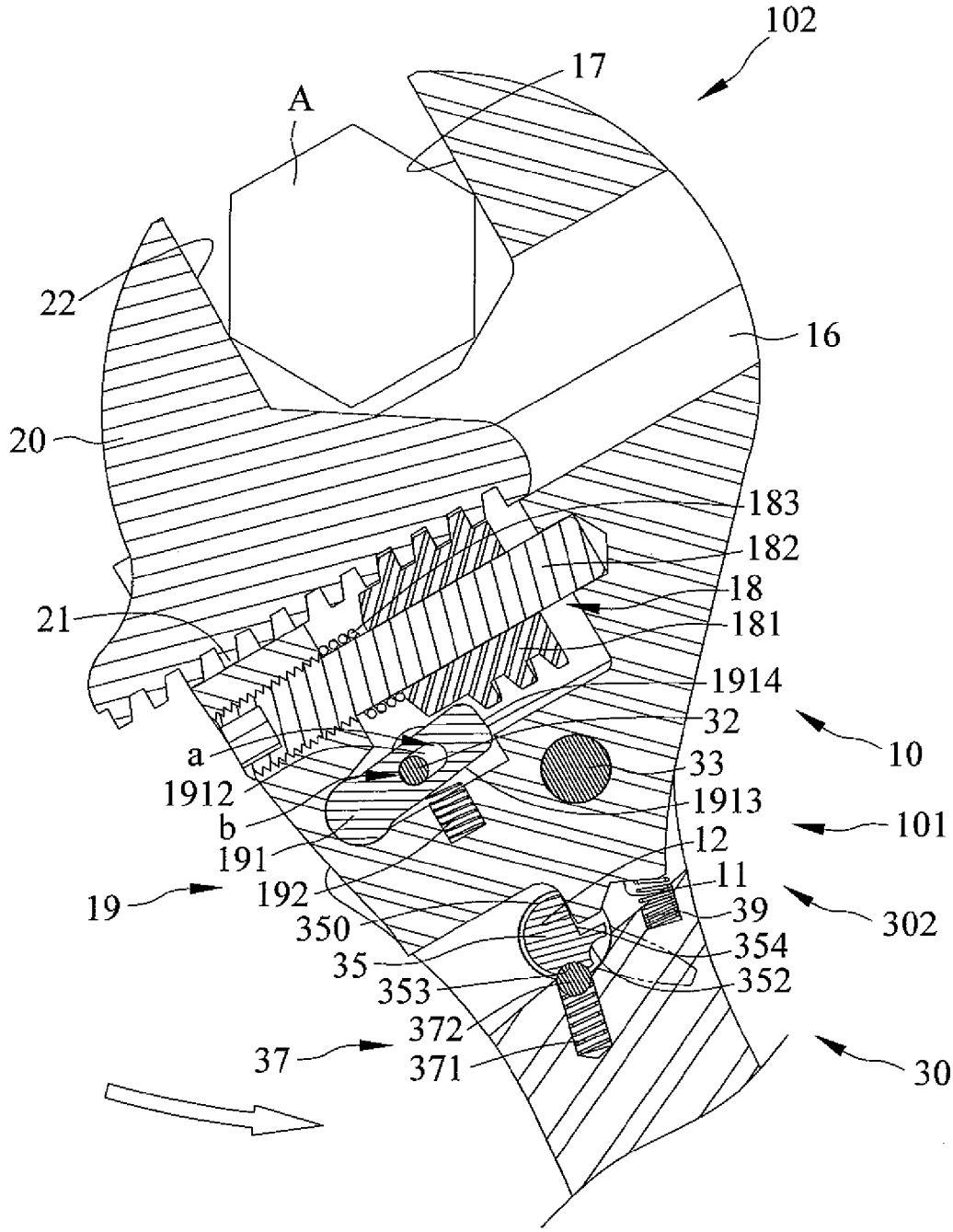
FIG. 9 is a continued view of FIG. 8, showing the operation of the adjustable wrench in the first operating direction moving relative to the object moving relative to the object engaged therewith.
Figure 10:
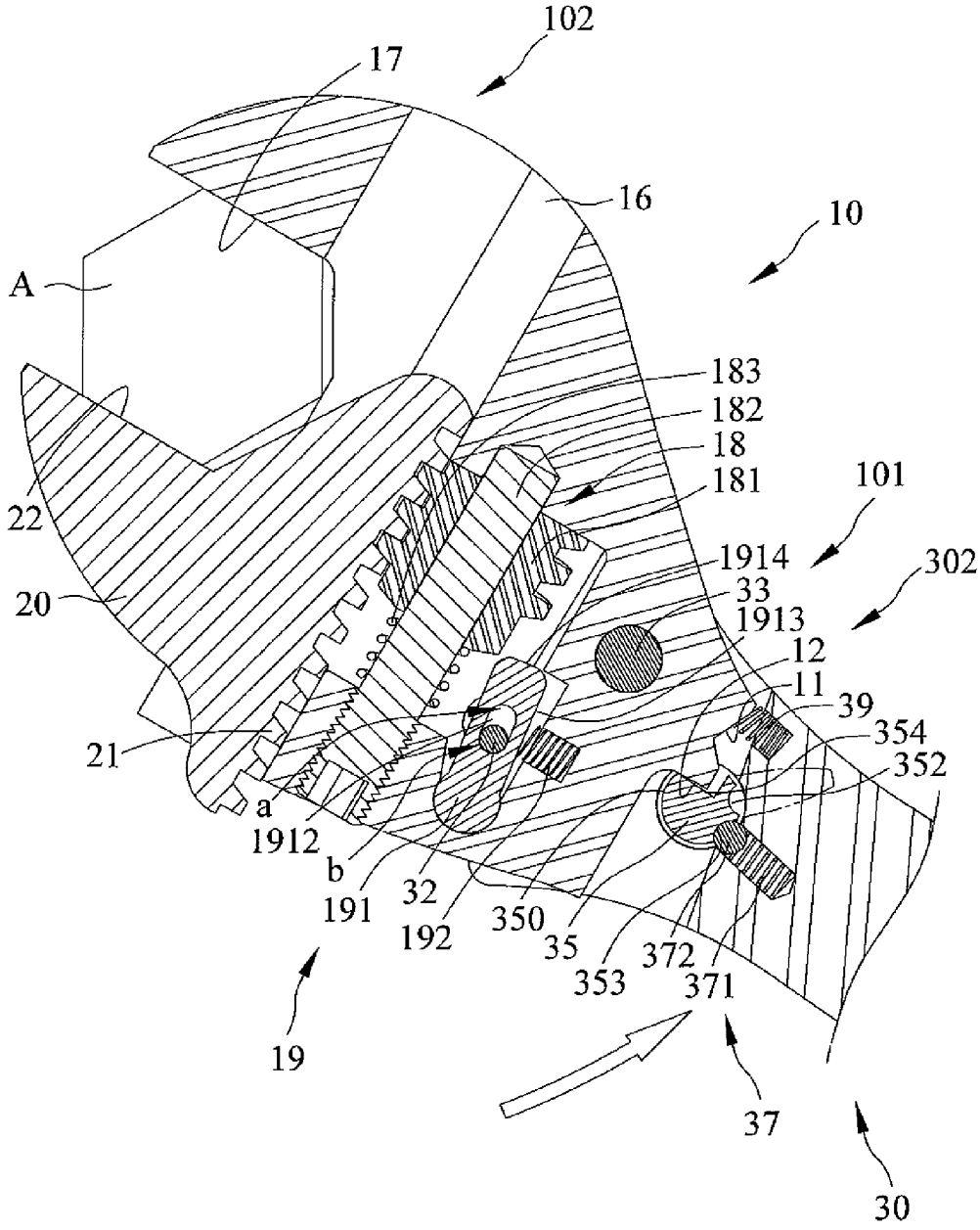
FIG. 10 is a continued view of FIG. 9, showing the operation of the adjustable wrench in the first operating direction moving relative to the object moving relative to the object engaged therewith.
Figure 11:
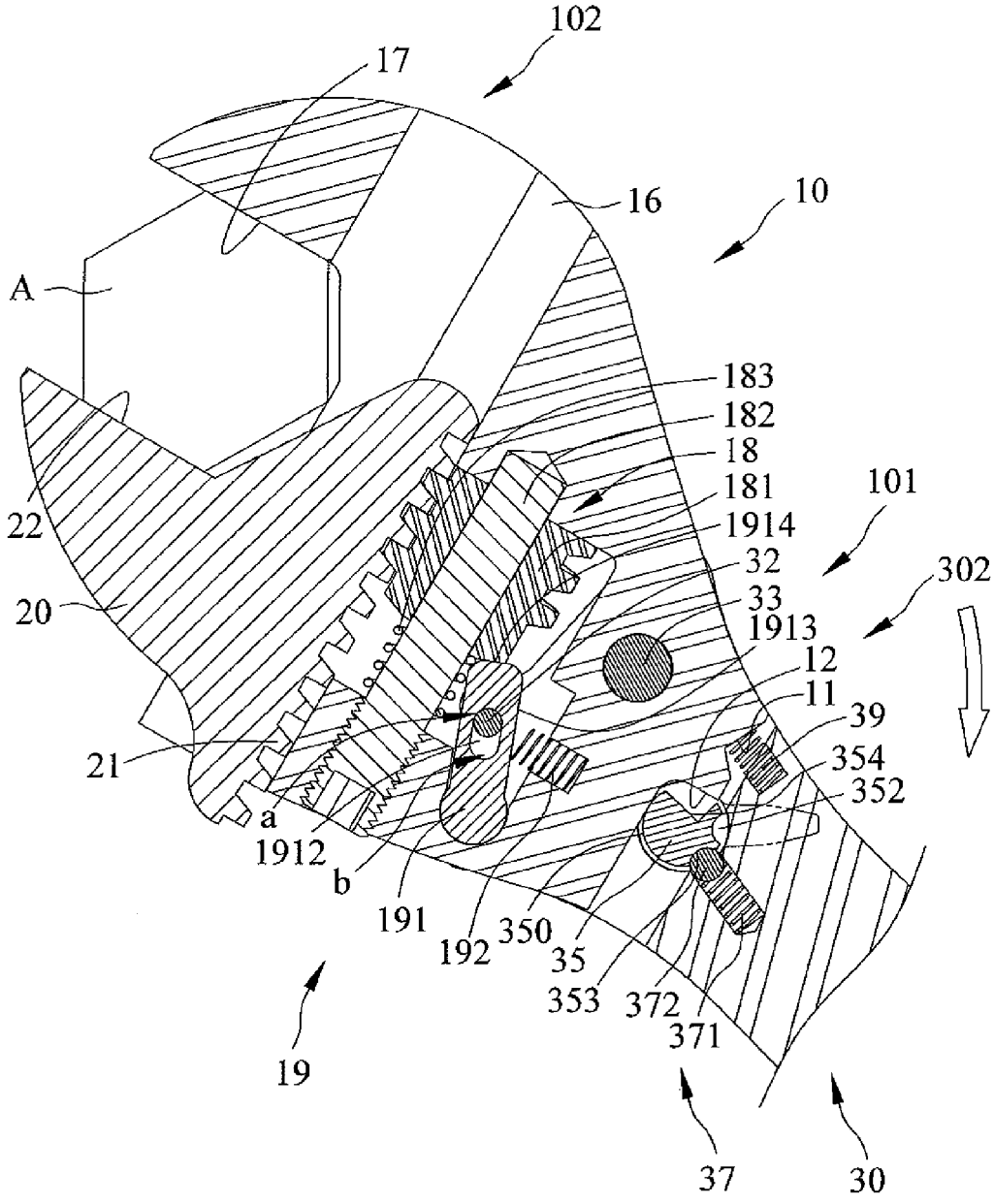
FIG. 11 is a continued view of FIG. 10, showing the operation of the adjustable wrench in a second operating direction reverse to the first operating direction wrenching the object.
Figure 12:
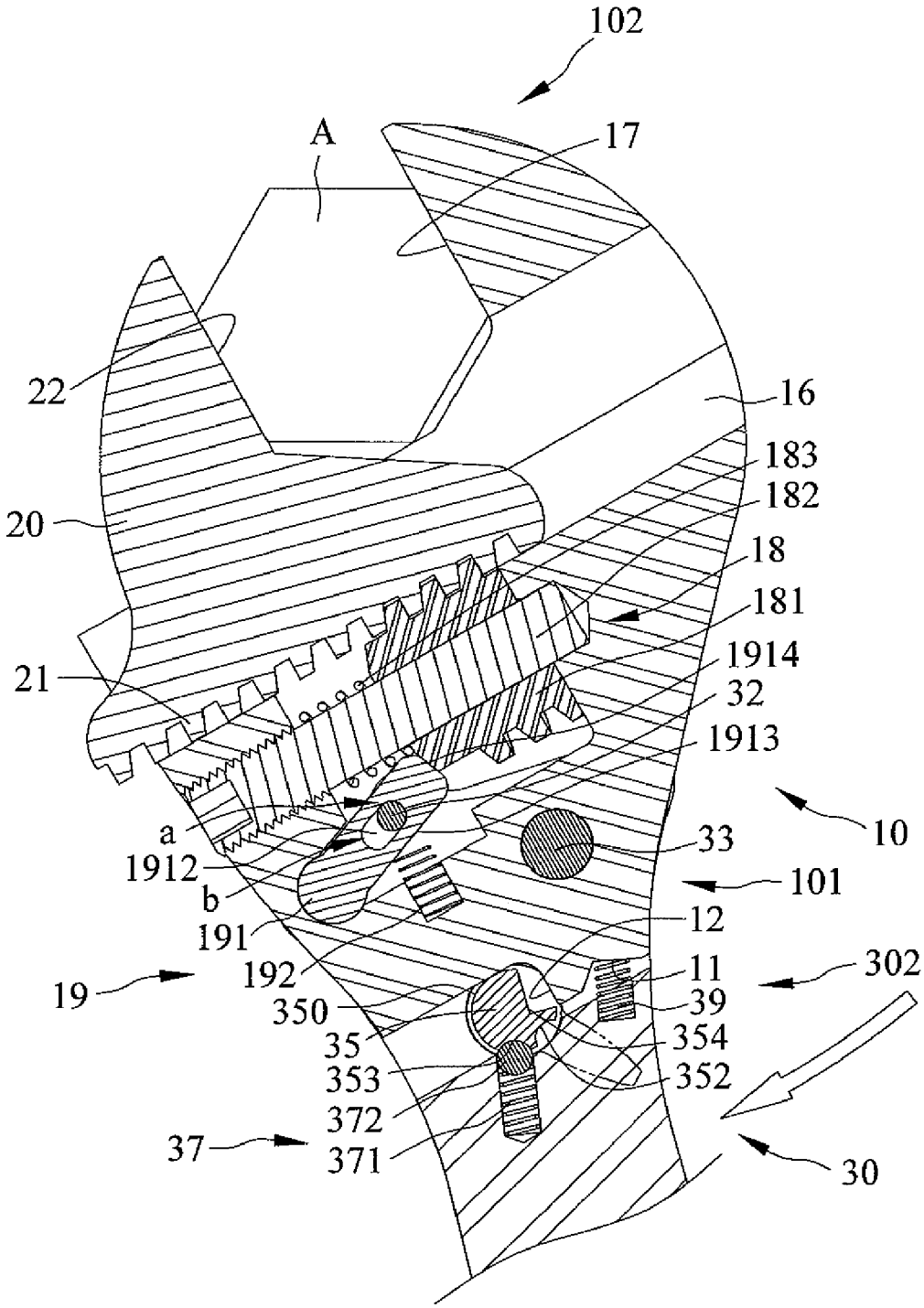
FIG. 12 is a continued view of FIG. 11, showing the operation of the adjustable wrench in the second operating direction wrenching the object.
Figure 13:
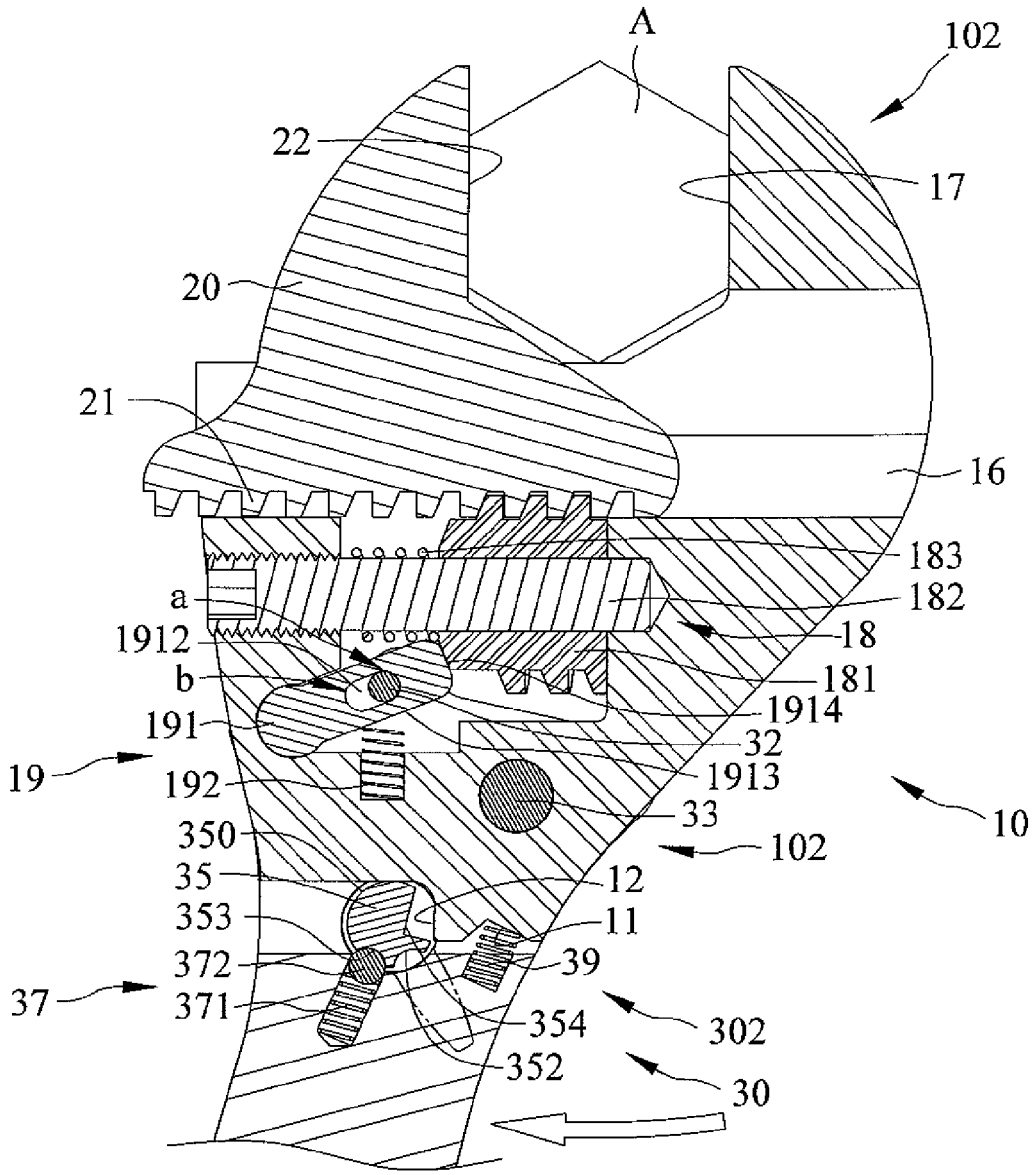
FIG. 13 is a continued view of FIG. 12, showing the operation of the adjustable wrench in the second operating direction wrenching the object.

FIGS. 1 through 13 show an adjustable wrench in accordance with a first embodiment of the present invention. The adjustable wrench includes a fixed jaw 10, a movable jaw 20, and a handle 30.

The fixed jaw 10 includes a first end 101, a second end 102, a chamber 14, a hole 15, and a groove 16 defined therein. The hole 15 is extended from the chamber 14 to an outer periphery of the fixed jaw 10. The chamber 14 includes an adjusting mechanism 18 and an abutting mechanism 19 disposed therein. The adjusting mechanism 18 includes a worm gear 181, a fixing member 182, and a first biasing member 183. The worm gear 181 includes the fixing member 182 inserted therein. The worm gear 181 is rotatable about and movable along the fixing member 182. The fixing member 182 is inserted through the hole 15. The first biasing member 183 is engaged with the worm gear 181. The abutting mechanism 19 includes an abutting member 191 and a second biasing member 192. The abutting member 191 is engagable with the worm gear 181 and engaged with the second biasing member 192.

The chamber 14 defines first and second receptacles 141, 142 receiving the abutting member 191 and the second biasing member 192 respectively. The abutting member 191 defines a fixing end 1911 and first and second engaging ends 1913 and 1914 and includes a slot 1912 extended therein. The abutting member 191 is pivotal. The first receptacle 141 pivotally bears the fixing end 1911. The slot 1912 includes a fastener 32 inserted therein. The fastener 32 is fixedly mounted on the handle 30. The slot 1912 defines first and second limiting ends a and b. The first engaging end 1913 includes an arcuate periphery. The first engaging end 1913 is engaged with the second biasing member 192.

The movable jaw 20 is movably received in the second end 102 of the fixed jaw 10 and engaged with the worm gear 181. The movable jaw 20 moves linearly relative to the fixed jaw 10 upon rotating the worm gear 181. The movable jaw 20 is movably received in the groove 16. The movable jaw 20 includes a plurality of engaging teeth 21 disposed one after another and engagable with the worm gear 181 successively and reciprocally.

The handle 30 is pivotally fixed to the fixed jaw 10 and includes a proximal end defining a connecting end 301 including the fixed jaw 10 pivotally joined thereto and a distal end defining a grasping end 302 allowing grasping by a user. The fixed jaw 10 and the handle 30 include a pivot 33 pivotally connecting therewith. The handle 30 includes a notch 38 extended therein. The fixed jaw 10 includes an orifice 13 extended therein and including the pivot 33 inserted therein. The handle 30 further includes two lugs including a gap 31 defined therebetween and including the second end 102 of the fixed jaw 10 received in the gap 31. The fixed jaw 10 and the handle 30 include a third biasing member 39 engaged therebetween. The third biasing member 39 is disposed between the two lugs. The fixed jaw 10 includes a periphery including a peripheral section 11 defined thereon. The third biasing member 39 includes a first distal end abutted against the first peripheral section 11 and a second distal end retained in the notch 38. The peripheral section 11 defines two slopes. The two slopes include an included angle and having different inclination directions. The two slopes include an obtuse included angle. Additionally, the handle 30 includes a cavity 34 and a channel 36 extended therein.

The adjustable wrench is operable in a first direction wrenching an object A and including the worm gear 181 stopped from moving along the fixing member 182 by the abutting member 191 fixedly abutting against the worm gear 181. The fixed jaw 10 includes a first clamping face 17, and the movable jaw 20 includes a second clamping face 22 respectively. The object A is clamped between the first and second clamping faces 17 and 22 when being wrenched. Additionally, the adjustable wrench operably moved in the first direction includes the second engaging end 1914 abutted against the worm gear 181 and includes the fastener 32 abutting against the first limiting end a of the slot 1912.

Moreover, the adjustable wrench is operable in a second direction moving relative to the object A and includes the worm gear 181 adapted to be moved with respect to the fixing member 182, the movable jaw 20 moving with respect to the fixed jaw 10, and the abutting member 191 not fixedly abutted against the worm gear 181. Additionally, the adjustable wrench operably moved in the second direction includes the fastener 32 moving between the first and second limiting ends a and b and is abutable against the second limiting end b.

Further, a switch 35 is rotatably disposed in the cavity 34 and operable in first and second switching positions. The switch 35 is operated in the first and second switching positions including the adjustable wrench operably moved in different directions wrenching the object A. The switch 35 includes a circumference 350 and defines an input end 351. The switch 35 includes first and second apertures 352 and 353 and a recess 354 defined in the circumference 350. The circumference 350 includes a cylindrical shape. The input end 351 is exposed outside the handle 30. Further, a detent mechanism 37 includes a fourth biasing member 371 and a detent member 372. The fourth biasing member 371 is engaged with the detent member 372. The fourth biasing member 371 includes a distal end retained in the channel 36. The detent member 372 includes a shape of a ball and is made of metal. The switch 35 operated in the first and second switching positions includes the detent member 372 engaged in the first and second apertures 352 and 353 respectively. Additionally, the fixed jaw 10 includes an extension 12. The switch 35 operated in the first switching position includes the circumference 350 abutting against the extension 12, and the switch 35 operated in the second switching position includes the recess 354 including a surface abutting against the extension 12.

Figure 14:
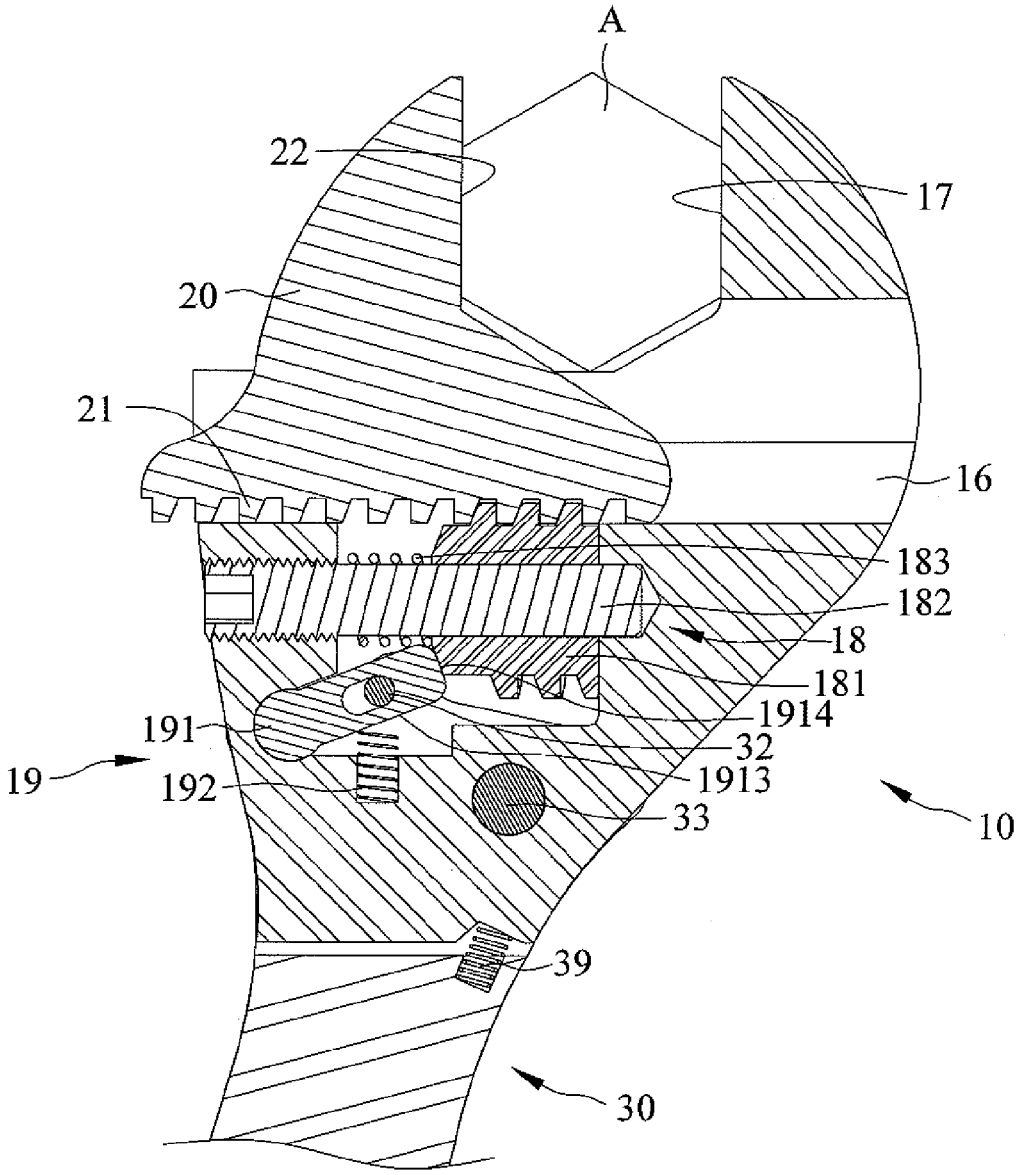
FIG. 14 is a cross-sectional view of an adjustable wrench in accordance with a second embodiment of the present invention.

FIG. 14 shows an adjustable wrench in accordance with a second embodiment of the present invention. The second embodiment differentiates from the first embodiment in that it does not include the cavity 34, the switch 35, the channel 36, and the detent mechanism 37. Likewise, the adjustable wrench of the second embodiment is operable in a first direction wrenching an object and includes the worm gear 181 stopped from moving along the fixing member 182 by the abutting member 191 fixedly abutting against the worm gear 181. The adjustable wrench of the second embodiment is operable in a second direction moving relative to the object A and includes the worm gear 181 adapted to be moved with respect to the fixing member 182 and including the movable jaw 20 moving with respect to the fixed jaw 10 and the abutting member 191 not fixedly abutted against the worm gear 181.

While the specific embodiments have been illustrated and described, numerous modifications come to mind without significantly departing from the spirit of invention, and the scope of invention is only limited by the scope of the accompanying claims.

What is claimed is:

1. An adjustable wrench comprising:

a fixed jaw including first and second ends, a chamber and a hole defined therein, with the hole extended from the chamber to an outer periphery of the fixed jaw, with the chamber including an adjusting mechanism and an abutting mechanism disposed therein, with the adjusting mechanism including a worm gear, a fixing member, and a first biasing member, with the worm gear including the fixing member inserted therein, with the worm gear rotatable about and movable along the fixing member, with the fixing member inserted through the hole, with the first biasing member engaged with the worm gear, with the abutting mechanism including an abutting member and a second biasing member, with the abutting member engagable with the worm gear and engaged with the second biasing member, wherein the chamber defines first and second receptacles receiving the abutting member and the second biasing member respectively, with the abutting member defining a fixing end and first and second engaging ends and including a slot extended therein, with the abutting member being pivotal, with the first receptacle pivotally bearing the fixing end, with the first engaging end engaged with the second biasing member;

a movable jaw movably received in the second end of the fixed jaw and engaged with the worm gear, with the movable jaw moving linearly relative to the fixed jaw upon rotating the worm gear; and a handle pivotally fixed to the fixed jaw and allowing grasping by a user;

wherein the adjustable wrench is operable in a first direction wrenching an object and including the worm gear stopped from moving along the fixing member by the abutting member fixedly abutting against the worm gear, with the adjustable wrench operably moved in the first direction including the second engaging end abutted against the worm gear, with the slot including a fastener inserted therein, with the fastener fixedly mounted on the handle; and wherein the adjustable wrench is operable in a second direction moving relative to the object and including the worm gear adapted to be moved with respect to the fixing member and including the movable jaw moving with respect to the fixed jaw and including the abutting member not fixedly abutted against the worm gear.

2. The adjustable wrench as claimed in claim 1, wherein the slot defines first and second limiting ends, wherein the adjustable wrench operably moved in the first direction includes the fastener abutted against the first limiting end of the slot, and wherein the adjustable wrench operably moved in the second direction includes the fastener moving between the first and second limiting ends.

3. The adjustable wrench as claimed in claim 2, wherein the fastener is abutable against the second limiting end.

4. The adjustable wrench as claimed in claim 1, wherein the handle includes a notch extended therein, wherein the fixed and the handle include a third biasing member engaged therebetween, with the fixed jaw including a periphery including a peripheral section defined thereon, with the third biasing member including a first distal end abutted against the first peripheral section and a second distal end retained in the notch.

5. The adjustable wrench as claimed in claim 4, wherein the peripheral section defines two slopes, with the two slopes including an included angle and having different inclination directions.

6. The adjustable wrench as claimed in claim 5, wherein the two slopes include an obtuse included angle.

7. The adjustable wrench as claimed in claim 4, wherein the handle includes two lugs including a gap defined therebetween and including the second end of the fixed jaw received in the gap, wherein the third biasing member is disposed between the two lugs.

8. The adjustable wrench as claimed in claim 1 further comprising a switch operable in first and second switching positions, wherein the switch operated in the first and second switching positions includes the adjustable wrench operably moved in different directions wrenching the object.

9. The adjustable wrench as claimed in claim 8, wherein the switch includes a circumference and defines an input end, and wherein the switch includes first and second apertures and a recess defined in the circumference.

10. The adjustable wrench as claimed in claim 9 further comprising a detent mechanism, with the detent mechanism including a fourth biasing member and a detent member, with the fourth biasing member engaged with the detent member, wherein the handle includes a cavity and a channel extended therein, with the cavity including the switch disposed therein, wherein the fourth biasing member includes a distal end retained in the channel, wherein the switch operated in the first and second switching positions includes the detent member engaged in the first and second apertures respectively, wherein the fixed jaw includes an extension, wherein the switch operated in the first switching position includes the circumference of the switch abutted against the extension, wherein the switch operated in the second switching position including the recess includes a surface abutted against the extension.

11. The adjustable wrench as claimed in claim 10, wherein the switch is rotatably disposed in the cavity.

12. The adjustable wrench as claimed in claim 10, wherein the fixed jaw and the handle include a pivot pivotally connecting therewith, wherein the handle includes a notch extended therein, wherein the fixed jaw includes an orifice extended therein and including the pivot inserted therein, wherein the fixed jaw and the handle include a third biasing member engaged therebetween, with the fixed jaw including a periphery including a peripheral section defined thereon, with the third biasing member including a first distal end abutted against the first peripheral section and a second distal end retained in the notch.

13. The adjustable wrench as claimed in claim 9, wherein the input end of the switch is exposed outside the handle.

* * * * *